United States Patent [19]

Liebermann

[11] 4,377,622

[45] Mar. 22, 1983

[54] METHOD FOR PRODUCING COMPACTS AND CLADDING FROM GLASSY METALLIC ALLOY FILAMENTS BY WARM EXTRUSION

[75] Inventor: Howard H. Liebermann, Gloversville, N.Y.

[73] Assignee: General Electric Company, Schenectady, N.Y.

[21] Appl. No.: 180,807

[22] Filed: Aug. 25, 1980

[51] Int. Cl.[3] ..... B22F 3/00

[52] U.S. Cl. ..... 428/605; 75/229; 419/4

[58] Field of Search ..... 75/226, DIG. 1, 229; 29/419; 428/605.

[56] References Cited

U.S. PATENT DOCUMENTS

| | | | |
|---|---|---|---|
| 3,824,097 | 7/1974 | Smythe et al. | 75/226 |
| 4,038,073 | 7/1977 | O'Handley et al. | 75/170 |
| 4,079,430 | 3/1978 | Fujishima et al. | 360/126 |
| 4,197,146 | 4/1980 | Frischmann | 75/251 |
| 4,201,837 | 5/1980 | Lupinski | 428/457 |
| 4,267,626 | 5/1981 | Terry | 29/419 |
| 4,298,382 | 11/1981 | Stempin et al. | 75/226 |

FOREIGN PATENT DOCUMENTS 53-57170 5/1978 Japan .

OTHER PUBLICATIONS

Miller et al., "Production & Consolidation of Amorphous Metal Powder", Second Intn'l. Conf. on Rapid Solidification, Reston, VA, 1980, (Mar.).

Clauer et al., "Consolidation Studies of Metallic Glass Strips and Microcrystalline Strips and Particulates", Second Intn'l. Conf. on Rapid Solidification, Reston, VA, 1980, (Mar.).

Wood, N., "Welding and Compacting Metallic Glasses", Machine and Tool Blue Book, pp. 78–83.

Udin et al., Welding for Engineers, John Wiley & Sons, Inc., Chapters 2 & 3, 1954.

*Primary Examiner*—Brooks H. Hunt

*Attorney, Agent, or Firm*—Stephen S. Strunck; James C. Davis, Jr.; James Magee

[57] ABSTRACT

Filaments of glassy metallic alloys prepared by chill block melt-spinning are consolidated under heat and pressure by an extrusion process. Products obtainable by the process include discrete bodies of glassy metallic alloys of substantially uniform composition and articles having one or more layers of glassy metallic alloy clad onto one or more non-glassy metallic alloy substrates.

34 Claims, 9 Drawing Figures

METHOD FOR PRODUCING COMPACTS AND CLADDING FROM GLASSY METALLIC ALLOY FILAMENTS BY WARM EXTRUSION

BACKGROUND OF THE INVENTION

Glassy metallic alloys, also commonly referred to as amorphous metallic alloys, do not exhibit the regular atomic structural periodicity of metals in the crystalline state. Glassy metallic alloys, therefore, in contrast to crystalline metals, do not exhibit well-defined peaks during X-ray diffraction measurements. From such diffraction measurements, however, it has been determined that amorphous metals have no long range structure and, in that respect, their atomic structures closely resemble those of the precursor liquid state.

Glassy metallic alloys generally possess physical properties such as hardness and strength far in excess of their crystalline counterparts. The magnetic properties of magnetic glassy metallic alloys generally also differ from those of their crystalline counterparts and are of considerable interest to manufacturers of electrical equipment. Since glassy magnetic metals, unlike normal crystalline magnetic metals, have no long range atomic order in their structure, the directionality of properties such as magnetization normally associated with crystal anisotropy is absent. Also, unlike normal metals, glassy metals are extremely homogeneous, being devoid of compositional heterogeneity, inclusion and structural defects. The lack of magnetic directionality gives metallic glasses good d-c magnetic properties including extremely low field requirements for saturation which allows magnetization reversal at extremely low fields (i.e., a low coercive field). Magnetic materials having low coercive field and low field requirements for saturation, i.e., high permeability, are commonly referred to as magnetically soft. Typical soft magnetic glassy metallic alloys in ribbon form are disclosed in U.S. Pat. No. 4,038,073 to O'Handley et al. which is herein incorporated by reference in its entirety.

Amorphous structures can be obtained by several techniques. Electroplating, vapor deposition, and sputtering are all techniques where the material is deposited on an atom-by-atom basis. Under appropriate conditions, the atoms are "frozen" in-situ on contact and usually cannot diffuse into the lower energy configurations associated with a more stable lattice. The resulting metastable structure is a non-crystalline glassy one. These processing methods, however, are not economically feasible for producing large commercial quantities.

Another method for producing glassy structures in some metals is by cooling rapidly from the liquid melt. Two major conditions apply in achieving the glassy structure by this method. First, the composition should be selected to have a high glass transition temperature, $T_g$, and a low melting temperature, $T_m$. Specifically, the $T_g/T_m$ ratio should be as large as possible. Second, the liquid should be cooled as rapidly as possible from about $T_m$ to below $T_g$. In practice, it is found that to produce metallic glasses, the cooling rate must be rapid enough, i.e., on the order of a million degrees centigrade per second, to circumvent crystallization which would otherwise occur. Even at the high cooling rates typically used, only alloys of certain compositions can be made amorphous by quenching from the melt. One class of metallic alloys consists of those containing "glass-forming" metalloid atoms, e.g., phosphorous, boron, silicon, and carbon as additions; usually in the 10 to 25 atomic percent range.

One technique for obtaining the very rapid cooling rates required is chill block melt-spinning, as described in U.S. Pat. No. 4,177,856, incorporated herein by reference in its entirety. Continuous melt-quenching techniques such as melt-spinning are very attractive from a production standpoint in that large amounts of thin glassy alloy filament, tape, etc., may be cast at speeds typically up to 50 m/s. Unless special equipment is used to guide and coil the filament, it will be cast from the spinning chill block into piles having an intertwined or tangled appearance as newly formed portions of the continuous filaments fall into open areas between previously ejected portions.

Metallic glasses undergo inhomogeneous plastic deformation through the formation of highly localized shear bands at temperatures well below the glass transition temperature, $T_g$. At temperatures well below $T_g$, these high strength, high modulus materials have fracture stresses marginally greater than the yield stress and thus do not exhibit substantial elongation in tension. In contrast, the mode of plastic deformation near $T_g$ is one in which the macroscopic strain in the specimen results from homogeneous deformation by viscous-like flow throughout the entire sample volume. The "plastic" transition temperature, $T_p$, corresponds to the changeover from one deformation mode to the other.

Discussion of the deformation behavior of glassy metallic alloys as a function of temperature appears not infrequently in the literature, e.g., Japanese patent S.53 (1978)-57170 of May 24, 1978 to T. Masumoto. In his patent, Masumoto describes the temperature regime between the crystallization temperature and the "ductile" transition temperature, in which uniform deformation easily occurs. Masumoto also proposes that forming processes such as rolling, punching, pressing, pulling out, and bending will be viable in that temperature regime; however, his examples are restricted to the rolling, pulling out and bending processes on a single ribbon and are primarily designed to demonstrate feasibility of easy deformation in the subject temperature regime.

One significant drawback to the utilization of glassy metallic alloys is that at the present time they can only be produced from the melt in large quantities in the form of filaments, ribbons, or flakes having thicknesses on the order of up to about 0.01 cm. If the processing parameters are changed to produce thicker ribbon, it is generally not possible to also obtain the very rapid cooling rates through the entire cross section required to avoid incipient crystallization. A second drawback is that the crystallization temperature forms an upper bound on the temperature to which the alloy may be heated in attempts to form large glassy metallic shapes from glassy filaments or ribbons. It is the relatively low crystallization temperature of glassy alloys which pose a formidable barrier to the direct application of prior art metalworking processes, e.g., extrusion, pressing and explosive bonding, to the formation of large bodies having a glassy atomic structure from glassy metallic alloy products of the chill block melt-spinning process.

The use of binders to agglomerate ribbons or flakes described, for example, in U.S. Pat. Nos. 4,197,146 and 4,201,837 to Frischmann and Lupinski, respectively, incorporated herein by reference, does not alleviate the drawback related to the crystallization temperature of the alloy and is also subject to temperature limits based on decomposition of the binder. Also, the presence of the binder inhibits development of properties projected for 100% dense bodies since some portion of the volume is occupied or made discontinuous by the presence of the binder.

Components or bodies formed from flakes (as described in U.S. Pat. No. 4,197,146, referenced above), discontinuous ribbon segments (as described in U.S. Pat. No. 4,201,837, referenced above), and powders without binders are subject to additional costs involved in making suitable flakes, discontinuous ribbon segments and powders compared to the costs of producing ribbons. Also, although physical properties are substantially uniform along the length of ribbons, such uniformity is generally not to be found among flakes, discontinuous ribbon segments or powders. Such variations in the form of end effects are particularly to be expected where the flakes or discontinuous ribbon segments are produced from the melt on casting wheels having local lines of low conductivity which may cause the formation of lines of brittle crystalline material along which the cast material fractures to define the flakes. It has generally been observed that components formed with or without binders have poorer soft magnetic characteristics than the flakes or discontinuous ribbon segments from which they are formed.

It is, therefore, an object of this invention to provide a binderless method for the consolidation of continuous filaments of glassy metallic alloys to form discrete dense glassy metallic alloy bodies of substantially uniform composition.

Another object of this invention is to provide dense glassy metallic alloy bodies of substantially uniform composition having properties and structure substantially the same as those of the filamentary glassy material from which they were formed.

A further object of this invention is to provide dense glassy magnetically soft metallic bodies of substantially uniform composition having superior soft magnetic properties substantially the same as those of the filamentary glassy soft magnetic material from which they are formed.

A still further object of this invention is to provide a method whereby continuous filaments of a glassy metallic alloy can be metallurgically bonded to a non-glassy metallic substrate while substantially maintaining the properties and structure of the starting glassy material.

Other objects of this invention will, in part, be obvious and will, in part, appear hereinafter.

BRIEF DESCRIPTION OF THE INVENTION

In accordance with the teachings of this invention, a method is provided to obtain conformation and metallurgical bonding between the surfaces of contiguous filaments of a glassy metallic alloy to produce nearly theoretically dense discrete glassy metallic alloy bodies, or layers of glassy metallic cladding, of substantially uniform composition.

In its method aspect, this invention briefly described in its most elemental sequence includes the steps of consolidating, in an essentially uniform manner, a preselected amount of filamentary glassy metallic alloy into the form of an elongated body having a density of about 50 to 60% of theoretical; heating the body to a substantially uniform temperature throughout between the plastic transition temperature and the crystallization temperature of the alloy; extruding the heated body while maintaining the temperature of the body at a substantially uniform value throughout in the range between the plastic transition temperature and the crystallization temperature of the alloy; and recovering a consolidated body of reduced cross section.

In its product or article aspect, this invention takes the form of a solid self-supporting dense body whose initial external shape is determined by the configuration of the extrusion equipment. Components or articles of manufacture requiring the unique properties of amorphous metals, e.g., high hardness, high strength, wear resistance and corrosion resistance, are particularly suitable for manufacture by this aspect of the invention. By appropriately configuring the starting materials, it is possible to produce a variety of bodies having one or more layers of glassy metallic alloy metallurgically clad onto one or more non-glassy metallic substrates wherein the glassy layers also have substantially the same properties and atomic structure as the intital filaments. Components or articles of manufacture for which layers of expensive materials or material having unique physical properties may be bonded to inexpensive metallic substrates are particularly suitable for manufacture by this variation of the invention.

By starting with magnetically soft filamentary magnetic alloy and performing the consolidation in accordance with the special steps of this invention, a body or clad-on layer having essentially the same soft magnetic properties as the parent filaments, and an atomic structure that is at least 50% glassy with any remainder crystalline, can be produced.

BRIEF DESCRIPTION OF THE DRAWINGS

The invention is more clearly understood from the following description taken in conjunction with the accompanying drawings in which.

DETAILED DESCRIPTION OF THE INVENTION AND THE PREFERRED EMBODIMENTS

Figure 1:
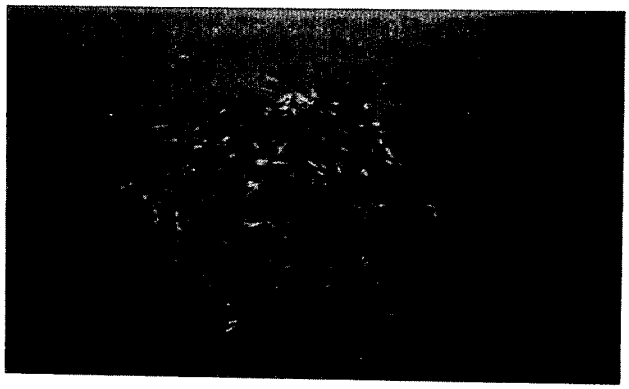
FIG. 1 is a photomacrograph of an intertwined three-dimensionally randomly disposed agglomeration of filamentary glassy metallic alloy.

In accordance with the teachings of this invention, discrete self-supporting dense bodies or clad-on layers having structures at least 50% glassy in nature, with any balance crystalline, are produced from an intertwined, tangled or otherwise three-dimensionally randomly disposed loose agglomeration of filaments of a glassy metallic alloy. A typical agglomeration is shown in FIG. 1. For the purposes of this invention, filaments are the thin, e.g., about 0.002 cm, product of the chill block melt-spinning process having lengths of at least several feet. These filaments have substantially parallel opposed major surfaces, i.e., top and bottom surfaces which are defined by the width and length dimensions of the ribbons. Edge surfaces, defined by the thickness and length or the thickness and width dimensions, having significantly less surface area than the top major surfaces, interconnect the top and bottom surfaces.

Figure 2:
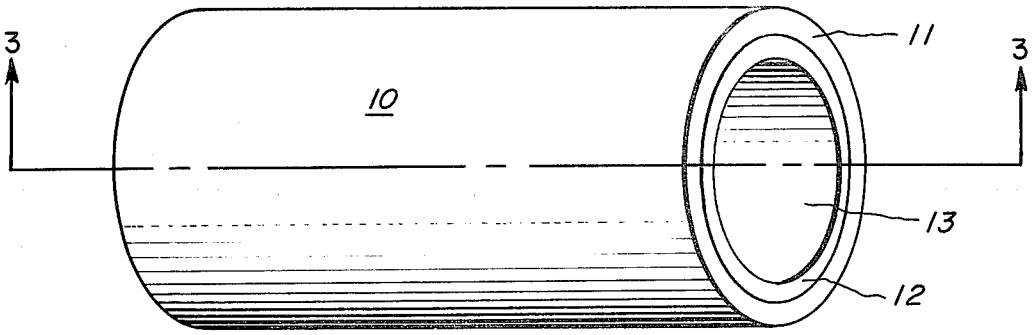
FIG. 2 is a three-dimensional schematic representation of a typical empty outer composite container or extrusion jacket.

Further and more detailed explanation of the practice of the invention can be facilitated with reference to the rest of the Figures in which FIG. 2 shows a duplex metallic container 10 into which the filamentary alloy of FIG. 1 may typically be placed in the practice of this invention. While a container of a single material (e.g., steel) will serve acceptably for the practice of this invention, it was found that duplex material containers were more effective than single material containers in meeting the difficulties inherent in the consolidation of glassy metallic filaments. Those difficulties are a direct result of the relatively low temperatures at which glassy metallic alloys will crystallize. Thus, in order to avoid crystallizing the material, the extrusion process must be carried out at temperatures below the crystallization temperature of the glassy alloy and the extrusion rate must be slow enough to avoid raising the temperature above the crystallization temperature due to excessive adiabatic heating from friction.

In the course of this invention it was determined that the tensile strength of the inner material 12 of the duplex container 10 should be equal to or greater than that of the glassy metallic alloy at the extrusion temperature to contain and consolidate the glassy alloy. The outer material 11 should be readily deformable to permit easy passage of the container 10 through the extrusion die. Steel having tensile strength equal to or greater than that of the glassy alloy at the extrusion temperature proved satisfactory for the inner material 12 and copper-nickel alloys, with nickel in the range of 10 to 30 weight percent, for the outer material 11.

The geometric shape of the metallic container 10 will primarily be a function of the product desired; right circular cylinders 13 and rectangular parallelopipeds with circular and rectangular cavities therein, respectively, being common examples. The wall thickness of the container 10 and the nature of the closure of the closed end is not critical except that the container, and its contents, must be capable of being extruded.

Figure 3:
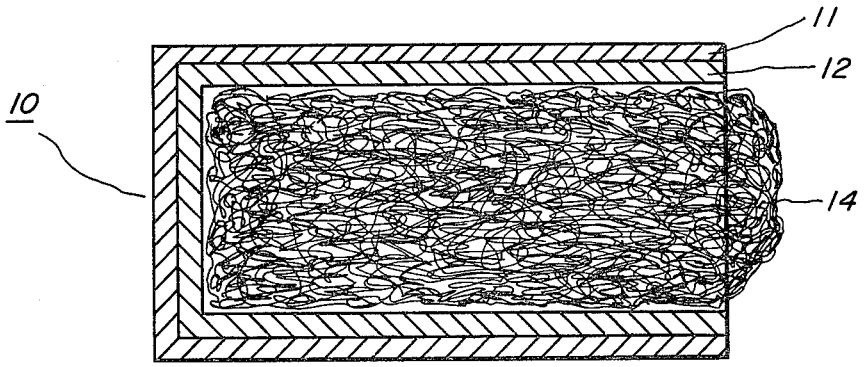
FIG. 3 shows schematically the containr of FIG. 2 in cross section along plane 3—3 with intertwined filamentary glassy metallic alloy loosely loaded therein.

Preparation of an assembly proceeds by loosely packing a preselected amount of filamentary amorphous metal 14 into the container 10 as shown in FIG. 3. No special arrangement of the filaments has been found to be advantageous. A mechanically-driven ram is advantageously used to prepack the filaments to a packing density of from between about 50% to about 60% percent of that theoretically possible although in most cases the desired prepacking density may be achieved by manual force. This operation may also proceed in an iterative fashion, i.e., loosely filling the container, or unfilled portion thereof, with a portion of the preselected amount of filamentary alloy 14 and then packing it more completely by the use of a mechanical ram until the container 10 has been filled with the preselected amount of filamentary glassy metal 14.

Figure 4:
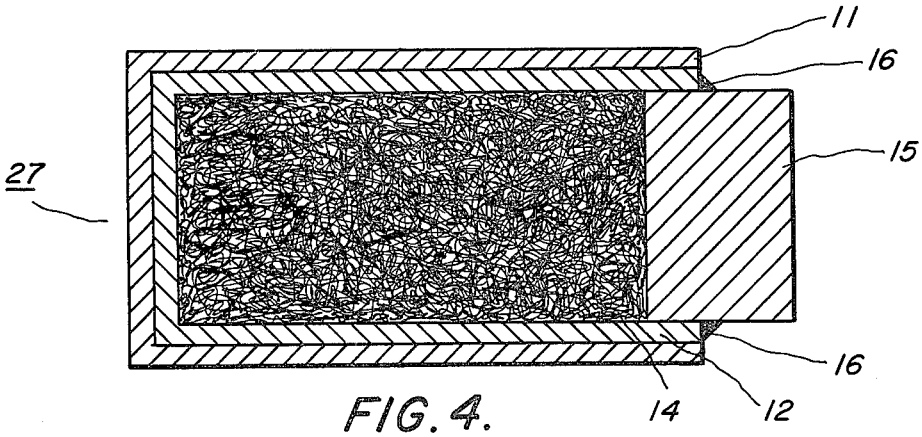
FIG. 4 shows schematically the container of FIG. 3 in cross section following precompression of the filamentary alloy, insertion of the plunger and welding of the plunger to the container.

After the container 10 has been filled with the preselected amount of filamentary alloy 14 and the filamentary alloy 14 prepacked to the requisite density, a hard steel plunger 15 is fitted into container 10 as shown in FIG. 4. The hard steel plunger 15 is generally designed to provide an interference fit with the inside of the container and may or may not be fit flushly with the end of the container. Tack or fillet welds 16 may be employed to insure that the plunger 15 stays in place. At the conclusion of this step an extrusion billet 27, as also shown in FIG. 4, has been formed.

The extrusion billet 27 is then heated in a typical heat treatment type furnace, preferably under an inert atmosphere, for a period of time sufficient to bring the billet 27 to a substantially uniform temperature throughout of at least the plastic transition temperature but less than the crystallization temperature of the filamentary alloy 14 contained therein. The heated billet 27 is then rapidly transferred to an extrusion press (not shown), to limit any decrease in temperature of the billet to less than about 10° C., and extruded. The pressure and extrusion rate are selected to extrude the billet without causing the temperature of the filamentary material to increase above the crystallization temperature of the alloy due to adiabatic heating caused by friction between the billet and the internals of the extrusion press. It has been determined experimentally that it is generally necessary to have the initial starting temperature of the billet approximately 10° to 50° C. below the crystallization temperature of the glassy alloy when using a duplex container in order to insure that the billet 27 and its contents do not overheat, thereby causing crystallization of the glassy alloy, at pressures of from about 4 MN to about 11 MN and extrusion rates of from about 2 cm/s to about 10 cm/s which are normally employed in this process. Reductions of cross-sectional area (i.e., the extrusion ratio) on the order of at least 3.5 to 1 are employed. Subsequent to the completion of the extrusion operation, the extruded product of reduced cross section may be cooled in still air, but preferably in a liquid bath such as water.

Figure 5:
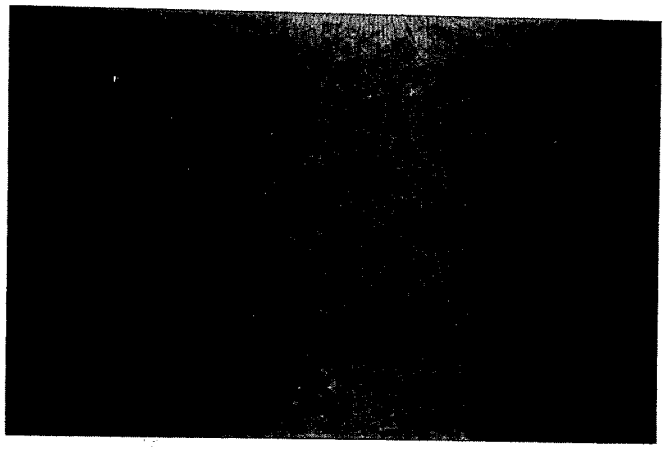
FIG. 5 is a photomicrograph at 150X magnification of a metallographically polished and etched glassy metallic alloy portion of an extruded product.

An extruded product is recovered following the extrusion step. In its simplest form, the filaments of glassy metallic alloy have been bonded together to form a solid dense glassy metallic alloy body contained in or surrounded by the outer metallic container. Removal of the outer metallic container by a conventional machining process yields a dense discrete glassy metallic body. For the purposes of this invention, an extruded product is considered glassy if its atomic structure is at least 50% glassy (or amorphous) with any remainder crystalline. The microstructure of such a glassy alloy body, transverse to the longitudinal axis of extrusion, is shown at 150X magnification in FIG. 5.

Careful examination of consolidated bodies produced early in the course of the invention showed that the orientation of the bonded ribbons varied continuously which indicated that tangential movement had occurred between adjacent ribbons during extrusion. It was determined in the course of the invention that the more random the disposition of the filamentary material 14 in the container 10 the better the bonding in the consolidated extruded product and the greater the densification. Additional experiments indicated that the void population observed in samples produced early in the course of the invention decreased as the extrusion ratio was increased and were essentially eliminated as the ratio approached about 4.5 to 1. The importance of shear is supposedly threefold in that it: (1) assists in obtaining geometric conformity between adjacent surfaces, (2) increases plastic flow and contacting interfacial area, and (3) disrupts oxide and other contaminant films.

An alternative to the above sequence, which promotes the removal of oxide films which might be on the surfaces of the filaments, is to conduct some of the processing steps in a vacuum chamber (not shown). Removal of oxide films promotes interfilamentary bonding. For example, before plunger 15 is inserted into the assembly containing the filamentary glassy alloy 14 the assembly may be placed into a vacuum chamber and the chamber pumped down to establish a pressure of not greater than about $10^{-4}$ Torr. After the reduced pressure has been maintained for at least one hour the plunger 15 is inserted and a seal weld is made about the entire periphery where the plunger joins the container. A further refinement to promote removal of oxide films is to heat the vacuum chamber to an elevated temperature below the crystallization temperature of the glassy alloy during the one hour holding period and during the seal welding. Laser and electron beam techniques, for example, are suitable for making the seal weld.

Figure 6:
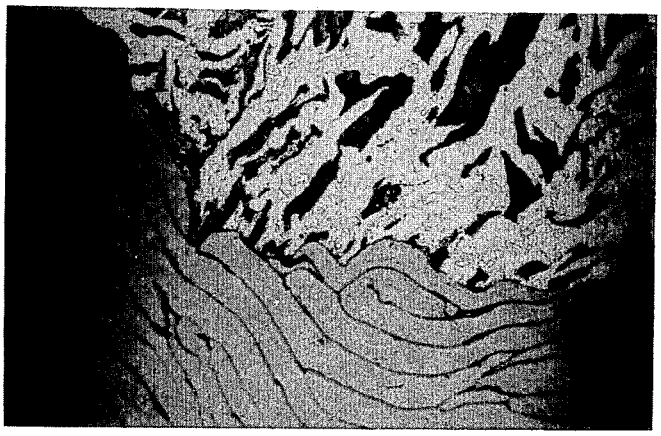
FIG. 6 is a photomicrograph at 750X magnification of the interface between plain carbon steel and densified consolidated $Fe_{81.5}B_{14.5}Si_4$ glassy alloy formed by coextrusion of the two materials.

Careful inspection of the extruded products revealed an unexpected result; the dense glassy metallic alloy product was metallurgically bonded, i.e., clad, to the steel extrusion jacket. An example of the cladding of conventional engineering materials with glassy alloys is shown in FIG. 6. FIG. 6 is a photomicrograph at 750X magnification of the interface between an outer metallic (steel) container and the dense consolidated glassy material of FIG. 5.

A subsidiary set of experiments showed that cladding was not possible when warm glassy alloy ribbon was merely pressed against a steel plate; the steel plate was indented without adhesion occurring. Thus, tangential motion was found to be as important during cladding as during consolidation by warm extrusion.

Figure 7:
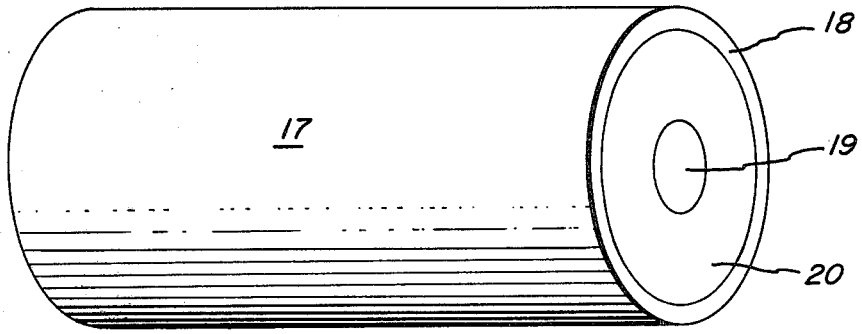
FIG. 7 is a three-dimensional schematic representation of an article produced by the method of this invention which has a non-glassy solid metallic core portion centrally disposed within a single material outer container with the space between the central core and the outer container filled with consolidated glassy metallic alloy.
Figure 8:
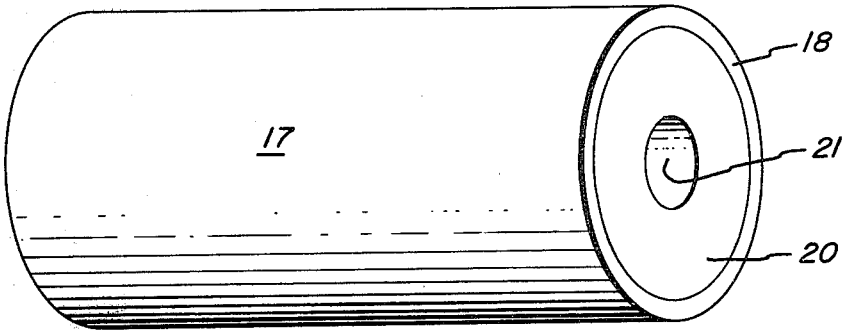
FIG. 8 is a three-dimensional schematic representation of a pipe-like article produced by additional processing of the article of FIG. 7 to remove the central core material.

FIG. 7 shows the assembly 17 of an additional embodiment of the invention. In this embodiment a solid non-amorphous metallic body 19 is centrally disposed within an outer metallic container 18 and consolidated filamentary amorphous metal 20 is located in the region between the two. Subsequent to extrusion in accordance with the teachings of this invention, advantage may be taken of the generally easier machinability of a non-amorphous metal, compared to amorphous metal, and the entire region 19 machined or leached away to form a hole 21 and the pipe-like object clad on the inside with an amorphous metal shown in FIG. 8. Alternatively, but not shown, the outer metallic container 18 may be removed by a conventional metal working process and a hole bored or drilled through the central region 19 to produce a pipe-like object clad on its exterior surface with amorphous metal.

Figure 9:
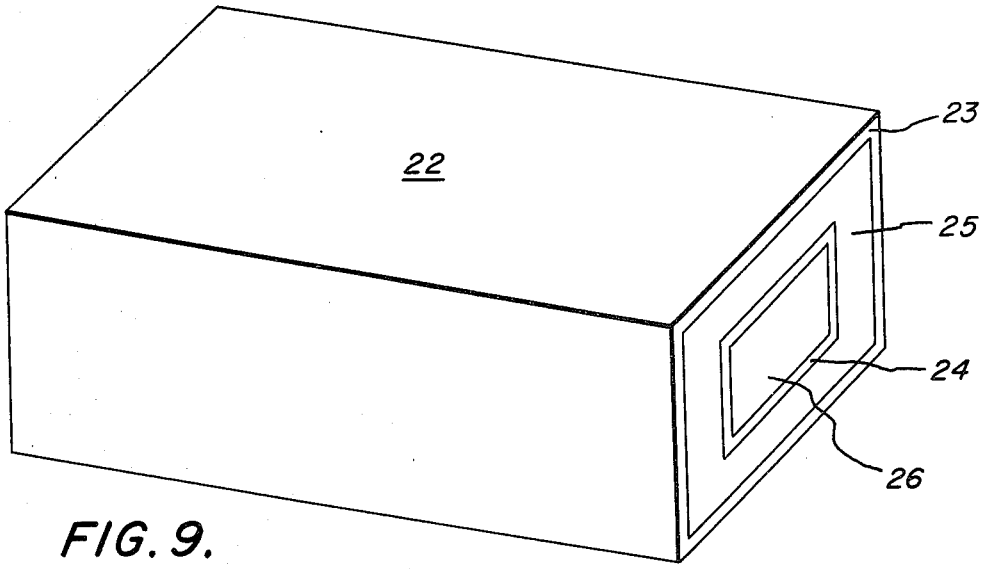
FIG. 9 is a three-dimensional schematic representation of another type of article, produced by the method of this invention, having two discrete regions of glassy material and two discrete regions with a non-glassy material.

FIG. 9 shows the assembly 22 of yet another more complex embodiment of this invention. Centrally disposed within an outer metallic container 23 is an inner metallic container 24 containing a first quantity of filamentary amorphous metal 26. A second quantity of filamentary amorphous material 25 is disposed in the region between the inner and outer metallic containers. The inner and outer containers need not be of the same metallic alloy nor do the first and second filamentary glassy metals need to be of the same composition. A circular variation of the assembly 22 is also ultimately functional. Subsequent to the extrusion of the circular variation of assembly 22, a hole may be drilled through the center of the first amorphous metal 26 and the outer container removed by a suitable metal working process to produce a pipe having a clad amorphous metal layer on both the inside and outside of the non-glassy metallic substrate.

It has also been discovered that the filamentary glassy metallic material may be inserted into the outer metallic container by any convenient means except when it is desired to produce a consolidated body having soft magnetic properties approaching those of magnetically soft filamentary starting material. In that case, it has been discovered that the introduction of permanent deformation in the form of localized shear bands, with their attendant strain fields, is detrimental to the ultimate goal of producing a body having magnetic properties approaching those of the magnetically soft filamentary starting material. Once the shear bands have been introduced, their effects cannot be completely mitigated by thermal processes such as annealing and they remain to the detriment of the production of consolidated bodies having very low coercive fields.

To obviate this undesired condition the soft magnetic filamentary material is best preheated to a temperature of at least its plastic transition temperature, but less than its crystallization temperature, and then carefully loosely loaded, without causing heterogeneous plastic flow of the alloy, into a container which has also been preheated to a temperature of at least the plastic transition temperature, but less than the crystallization temperature of the filamentary soft magnetic glassy metallic alloy. Also, in this case, the filling is best accomplished in one iteration with the plunger preheated to essentially the temperature of the container and inserted without causing any deformation of the filamentary material. The remainder of the processing, including extrusion, then follows the previous teachings. After the extrusion process has been completed, subsequent annealing, particularly in the presence of a magnetic field, may be required to optimize the soft magnetic properties of the consolidated body.

The invention will be further described by the following examples. It will be understood, however, that although these examples may describe in detail certain preferred operating variables and proportions within the contemplation of the invention, they are provided primarily for purposes of illustration and the invention in its broader aspects is not limited thereto.

EXAMPLE I

Preparation for warm extrusion consisted of loading 93 grams of filaments of $Fe_{81.5}B_{14.5}Si_4$ having a width to thickness ratio of 20 in to a ~25 mm bore plain carbon steel container having a wall thickness of ~12 mm.

Loading into the extrusion container was accomplished by sequentially packing 4–5 g lots of the alloy into the container until the total ribbon mass was inserted with a pre-extrusion packing density of ~60%. After this preparatory cold loading operation, a maraging steel plunger was force fit into the steel jacket and the assembled extrusion billet heated in a furnace under an argon atmosphere until the extrusion temperature was achieved substantially uniformly throughout the billet, at which time the assembly was inserted into a preheated conventional 11 MegaNewton (MN) extrusion press containing a die having a 130° entry angle. By extrusion, the outside diameter was reduced to 24 mm (i.e., an extrusion ratio of about 4.5 to 1). The steel jacket was then removed by a machining process and the glassy metallic alloy body was examined by light microscopy and found to have very uniform consolidation, i.e., densification, across a transverse section and, by X-ray analysis, to be substantially devoid of crystalline material, i.e., less than 10% crystallinity.

EXAMPLE II

Following the same general procedure of Example I, a duplex extrusion jacket, having external dimensions of approximately 5 cm dia. by 10 cm length, of Cu-10Ni alloy having a 0.2 mm thick steel liner was loaded with 85 g of $Fe_{81.5}B_{14.5}S_4$ intertwined glassy alloy filament. The assembled billet was heated to a substantially uniform temperature throughout of about 570 K. Extrusion with cross-sectional area reduction of 4.5 to 1 was conducted using a 7 MN running, i.e., steady state, load. A billet surface temperature of 600 K was measured by contact pyrometry immediately upon completion of the extrusion step. The temperature rise of about 30 K is substantially less than the temperature rise of greater than 100 K typically measured when using all-steel containers and the higher extrusion loads (i.e., about 11 MN) required to extrude the all-steel containers. The duplex jacket was then removed by a conventional machining process and subsequent magnetic measurements confirmed that the extruded consolidated body was 100% glassy.

EXAMPLE III

Again following the same general procedures of Example I, 88 g of $Fe_{81.5}B_{14.5}Si_4$ intertwined glassy alloy filament were carefully loaded into a single material extrusion jacket made of Cu-30Ni alloy and closed with a plunger to form a billet. Care was taken to minimize heterogeneous deformation of the glassy metallic alloy during the loading and closing steps. The billet was heated to a substantially uniform temperature throughout of about 600 K and extruded to a 4.5 to 1 area reduction ratio using a running load of approximately 6.7 MN. The jacket was then machined from the consolidated body and a sample cut from the resulting rod was magnetically measured. The coercivity of the as-consolidated sample was 440 mOe in a 1 Oe drive field. Subsequent annealing for 1h at 600 K resulted in a 200 mOe coercive field using the same drive field.

The consolidated product was then examined metallographically. Numerous voids and unbonded areas were observed in the areas away from the container. The glassy matallic alloy had been deeply imbedded into and bonded to (i.e., clad) the container. The lack of bonding, or consolidation, compared to the product of Example II, is attributed to the absence of the inner steel liner; the shear forces were preferentially expended at the more easily deformed glassy alloy-to-container interface than at the contiguous filament-to-filament surface interfaces.

What I claim as new and desired to secure by Letters Patent of the United States is:

1. The method for consolidating glassy metallic alloy in filamentary form comprising the steps of:

(a) preparing an assembly of at least an outer metallic container having one end open and a preselected amount of intertwined filamentary glassy metallic alloy disposed substantially uniformly therein and packed to a density of from about 50% to about 60% of theoretical;

(b) closing said open end by inserting a plunger into said open end forming thereby an extrusion billet;

(c) heating said extrusion billet to a substantially uniform temperature throughout, said temperature being in the range between the plastic transition temperature and the crystallization temperature of said alloy;

(d) extruding said billet to reduce the cross section thereof by an extrusion ratio of at least about 3.5 to 1 while maintaining the temperature of said billet at a substantially uniform value throughout in the range between the plastic transition temperature and the crystallization temperature of said alloy; and (e) recovering an extruded product of reduced cross section in which the contiguous surface areas of said intertwined filamentary glassy metallic alloy have been metallurgically bonded together by the application of inter-filament shearing forces to form a solid dense glassy metallic alloy body surrounded by and metallurgically bonded to said container.

2. The method of claim 1 wherein said outer metallic container is a composite of a first metal surrounding a second metal, said second metal being harder and stronger than said first metal and being interposed between said first metal and said intertwined filamentary glassy metallic alloy.

3. The method of claim 2 wherein said first metal is an alloy of copper and nickel and said second metal is steel, said nickel being present in said alloy in the range of from about 10 weight percent to about 30 weight percent.

4. The method of claim 1 further including the step of removing said outer metallic container from said extruded product by a metalworking process.

5. A consolidated dense discrete metallic body that is at least 50% glassy with any remainder crystalline, said body being prepared in accordance with the method of claim 4.

6. The body of claim 5 wherein said body is totally glassy.

7. The body of claim 5 wherein said body is at least 80% dense.

8. The method of claim 1 in which said preselected amount of substantially intertwined filamentary glassy metallic alloy is disposed in said metallic container by repeatedly partially filling said container with a portion of said preselected amount of said alloy and partially compacting said portion of said filamentary alloy to a substantially uniform packing density of about at least 50% to no more than about 60% of theoretical until said container is filled with said preselected amount of said alloy.

9. The method of claim 1 wherein the closing step is accomplished in a vacuum chamber, said vacuum chamber having been evacuated to a reduced pressure of at least less than $10^{-4}$ Torr and maintained thereat for at least one hour prior to insertion of said plunger.

10. The method of claim 9 wherein said vacuum chamber is maintained at a substantially constant elevated temperature below the crystallization temperature of said alloy.

11. The method of claim 1 further including the step of tack welding said plunger to said container.

12. The method of claim 9 further including the step of seal welding said plunger to said container.

13. The method of claim 12 wherein said seal weld is effected by an electron beam.

14. The method of claim 1 wherein said heating step is carried out rapidly by means of induction heating apparatus.

15. The method of claim 1 wherein said assembly comprises a solid crystalline metallic core centrally disposed within said outer metallic container with said preselected amount of intertwined filamentary glassy metallic alloy being disposed within the region between said core and said container.

16. A composite body produced by the method of claim 15 in which the contiguous surface areas of said intertwined filamentary glassy metallic alloy have been metallurgically bonded together to form a consolidated dense region by the application of inter-filament shearing forces and in which the surface areas of said intertwined filamentary glassy metallic alloy contiguous with said core and said container have been metallurgically clad to said core and said container by said shearing forces, said consolidated dense region being at least 50% glassy with any remainder crystalline.

17. The composite body of claim 16 wherein said dense region is totally glassy.

18. The composite body of claim 16 wherein said dense region is at least 80% dense.

19. The method of claim 1 wherein said assembly comprises a hollow crystalline metallic core centrally disposed within said outer metallic container with a first preselected amount of intertwined filamentary glassy metallic alloy disposed within said hollow core and a second preselected amount of intertwined filamentary glassy metallic alloy disposed within the region between said core and said container.

20. The method of claim 19 wherein said first preselected amount of glassy alloy has substantially the same chemical composition and physical properties as said second preselected amount of glassy alloy.

21. A composite body produced by the method of claim 19 in which the contiguous surface areas of said intertwined filamentary glassy metallic alloy in said core have been metallurgically bonded together to form a first consolidated dense region by the application of inter-filament shearing forces, the contiguous surface areas of said intertwined filamentary glassy metallic alloy in said region between said core and said container have been metallurgically bonded together to form a second consolidated dense region by the application of inter-filament shearing forces, and in which the surface areas of said intertwined filamentary glassy metallic alloys contiguous with said core and said container have been metallurgically clad to said core and said container by said shearing forces, said first and second consolidated dense region being at least 50% glassy with any remainder crystalline.

22. The composite body of claim 21 wherein said first region is totally glassy.

23. The composite body of claim 21 wherein said second region is totally glassy.

24. The composite body of claim 21 wherein said first region is at least 80% dense.

25. The composite body of claim 21 wherein said second region is at least 80% dense.

26. The method for consolidating magnetically soft glassy metallic alloy in filamentary form while substantially maintaining the soft magnetic properties of the alloy comprising the steps of:

(a) preparing an assembly comprising at least an outer metallic container having one end open and a preselected amount of magnetically soft intertwined filamentary glassy metallic alloy disposed loosely and substantially uniformly therein by preheating said alloy to a temperature in the range between the plastic transition temperature and the crystallization temperature of said alloy and disposing said alloy in said container without causing heterogeneous plastic flow of said alloy, said container being maintained at a substantially uniform temperature throughout in the range between the plastic transition temperature and the crystallization temperature of said alloy;

(b) closing said open end by inserting a plunger preheated to a temperature in the range between the plastic transition temperature and the crystallization temperature of said alloy into said open end without compressing said magnetically soft filamentary alloy disposed therein to form an extrusion billet;

(c) extruding said heated billet to reduce the cross section thereof by an extrusion ratio of at least about 3.5 to 1 while maintaining the temperature of said billet at a substantially uniform value throughout in the range between the plastic transition temperature and the crystallization temperature of said alloy; and (d) recovering an extruded product of reduced cross section in which the contiguous surface areas of said interwined filamentary magnetically soft glassy metallic alloy have been metallurgically bonded together by the application of inter-filament shearing forces to form a solid dense magnetically soft glassy metallic alloy body and in which the surface areas of said intertwined filamentary magnetically soft glassy metallic alloy contiguous with said container have been metallurgically bonded to said container by said shearing forces.

27. The method of claim 26 further including the step of removing said outer metallic container from said extruded product by a metalworking process.

28. A consolidated dense discrete magnetically soft metallic body that is at least 50% glassy with any remainder crystalline, said body being prepared in accordance with the method of claim 27.

29. The body of claim 28 wherein said body is totally glassy.

30. The body of claim 28 wherein said body is at least 80% dense.

31. The method of claim 26 wherein said outer metallic container is a composite of a first metal surrounding a second metal, said second metal being harder and stronger than said first metal and being interposed between said first metal and said magnetically soft intertwined filamentary glassy metallic alloy.

32. The method of claim 31 wherein said first metal is an alloy of copper and nickel and said second metal is steel, said nickel being present in said alloy in the range of from about 10 weight percent to about 30 weight percent.

33. The method of claim 26 wherein the closing step is accomplished in a vacuum chamber, said vacuum chamber having been evacuated to a reduced pressure of at least less than $10^{-4}$ Torr and maintained thereat for at least one hour prior to insertion of said plunger.

34. The method of claim 33 wherein said vacuum chamber is maintained at a substantially constant elevated temperature below the crystallization temperature of said alloy.

* * * * *